US007082658B1

(12) United States Patent
Lin

(10) Patent No.: US 7,082,658 B1
(45) Date of Patent: Aug. 1, 2006

(54) INTAKE CONTROL VALVE ASSEMBLY OF A RIVET-NUT GUN

(76) Inventor: Yu-Ching Lin, P. O. Box 96-405, Taipei 106 (TW)

( * ) Notice: Subject to any disclaimer, the term of this patent is extended or adjusted under 35 U.S.C. 154(b) by 0 days.

(21) Appl. No.: 11/189,876

(22) Filed: Jul. 27, 2005

(51) Int. Cl.
*B21J 15/10* (2006.01)
*B21J 15/22* (2006.01)

(52) U.S. Cl. ..... 29/243.525; 72/391.4

(58) Field of Classification Search ..... 72/391.4, 72/391.6; 29/243.523, 243.524, 243.525
See application file for complete search history.

(56) References Cited

U.S. PATENT DOCUMENTS 5,500,990 A * 3/1996 Wihan ..... 29/243.525
5,697,137 A * 12/1997 Frearson et al. ..... 29/243.525
6,014,801 A * 1/2000 Wilcox ..... 29/243.525
6,272,899 B1 * 8/2001 Bentivogli ..... 29/243.525

* cited by examiner

*Primary Examiner*—David Jones
(74) *Attorney, Agent, or Firm*—Troxell Law Office, PLLC

(57) ABSTRACT

An intake control valve assembly of a rivet-nut gun comprises mainly a handle and a pressure accumulator; the top of the pressure accumulator is furnished with a valve cylinder, in which an intake control valve assembly is loaded; by means of a trigger, the pressure air can be guided to flow via the intake control valve assembly and into the pressure accumulator so as to push a piston in the pressure accumulator to move up; by means of the piston rod moving in the hydraulic chamber, a hydraulic pressure is generated to facilitate a pull rod to perform riveting work.

4 Claims, 6 Drawing Sheets

INTAKE CONTROL VALVE ASSEMBLY OF A RIVET-NUT GUN

BACKGROUND OF THE INVENTION

1. Field of the Invention

This invention relates to a rivet-nut gun, and particularly to an intake control valve assembly of a rivet-nut gun.

2. Description of the Prior Art

In a conventional rivet-nut gun, the pressure accumulator under the handle is furnished with a piston with a piston rod; the upper part of the piston is mounted with a spring so as to have the piston maintained a pushing-down force; during riveting work, a trigger is used for controlling a pressure air to flow in; when the pressure air pushes the piston to move upwards, the piston rod on the piston will generate a hydraulic pressure in the hydraulic chamber for a riveting work.

SUMMARY OF THE INVENTION

The prime object of the present invention is to provide a rivet-nut gun, in which the pressure accumulator under the handle has an inner space to be partitioned into two spaces without loading any spring therein; the motion of the piston is controlled with a trigger on the handle, i.e., the pressure air is guided to flow into the upper space of the piston so as to push the piston to move for riveting work.

Another object of the present invention is to provide a rivet-nut gun, in which a valve cylinder is furnished between the handle and the pressure accumulator; in the valve cylinder, an intake control valve assembly is loaded; a valve in the trigger is used for controlling a pressure air to flow in; the pressure air will push the valve rod to move; simultaneously, the V-shaped ring groove on the valve rod will move so as to enable the pressure air to flow into a space under the piston, and to push the piston to move upwards with a force for riveting work.

Still another object of the present invention is to provide a rivet-nut gun, in which the intake control valve assembly loaded in the hollow cylinder of the valve cylinder includes a plurality of seal rings and spring rings; a valve rod is mounted in the hollow space of the seal rings and the spacing rings; outer end of the valve rod is mounted with a spring to provide a pushing force; during riveting work, the trigger will push the valve so as to have pressure air flowed in via the intake control valve assembly, and to push the valve to move, and the pressure air will provide the piston with a driving force through the V-shaped ring groove, the through hole, the guide pipe and the lower space of the pressure accumulator.

A further object of the present invention is to provide a rivet-nut gun, in which the valve rod has a cylindrical hole, and one end thereof is pushed with a spring; the outer surface thereof is furnished with a ring-shaped groove in communication with a center cylindrical hole; when the valve rod is pushed with pressure air to move, the ring-shaped groove on the outer surface will be in communication with the upper space of the piston so as to have the air pressed exhausted into the atmosphere.

A still further object of the present invention is to provide a rivet-nut gun, in which the outer end of the valve rod is mounted with a fastening ring having a center cylindrical hole, and the outer surface thereof is furnished with ring-shaped groove and through hole; the ring-shaped groove thereof is in communication with the intake passage of the hollow cylinder so as to enable pressure air to flow via the passage hole, the ring-shaped groove of the fastening ring, the through hole, and to flow into the center cylindrical hole of the fastening ring to drive the valve rod to move during riveting work.

DETAILED DESCRIPTION OF THE PREFERRED EMBODIMENT

Figure 1:
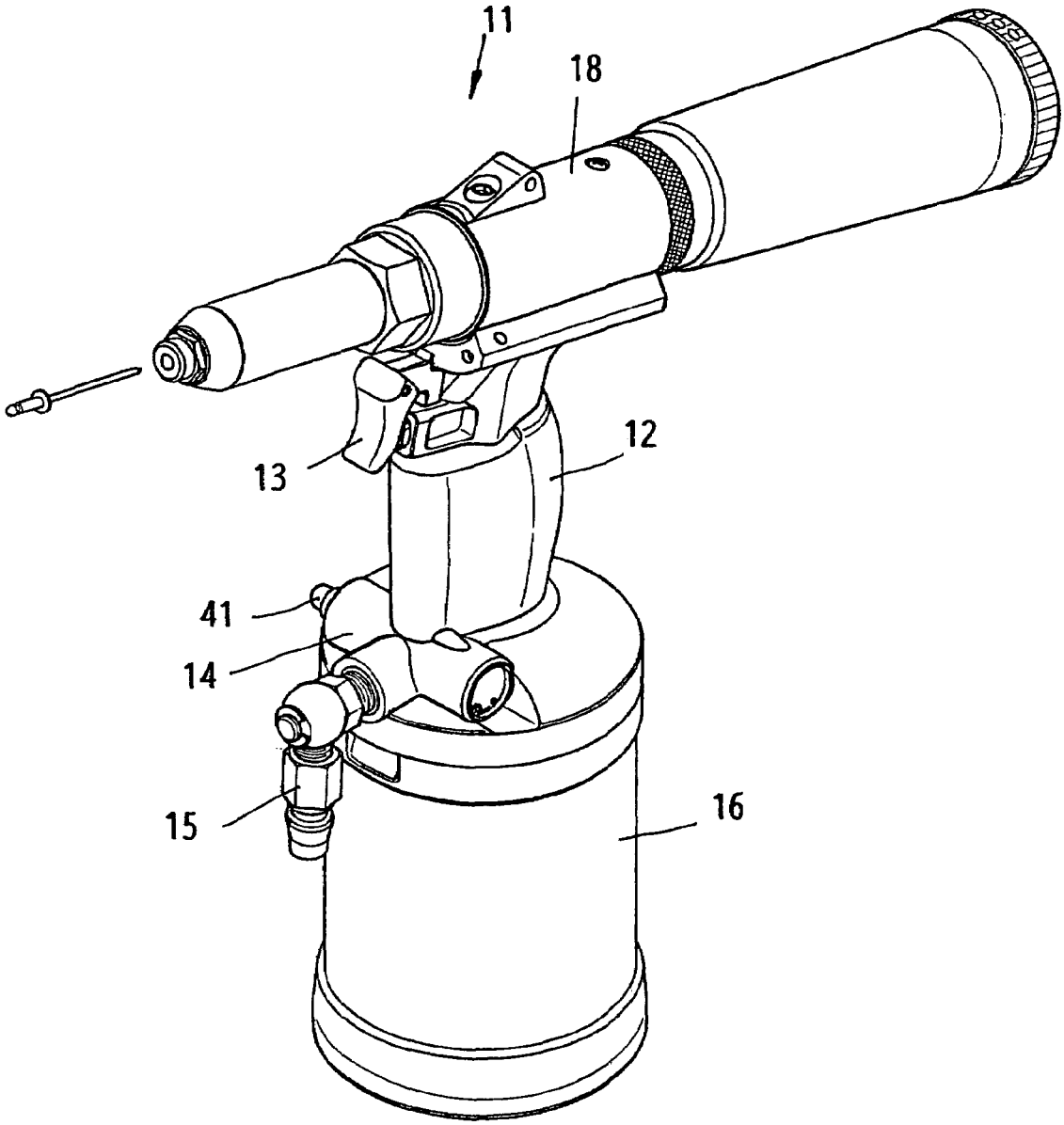
FIG. 1 is a plan view of a pneumatic rivet-nut gun of the present invention.
Figure 2:
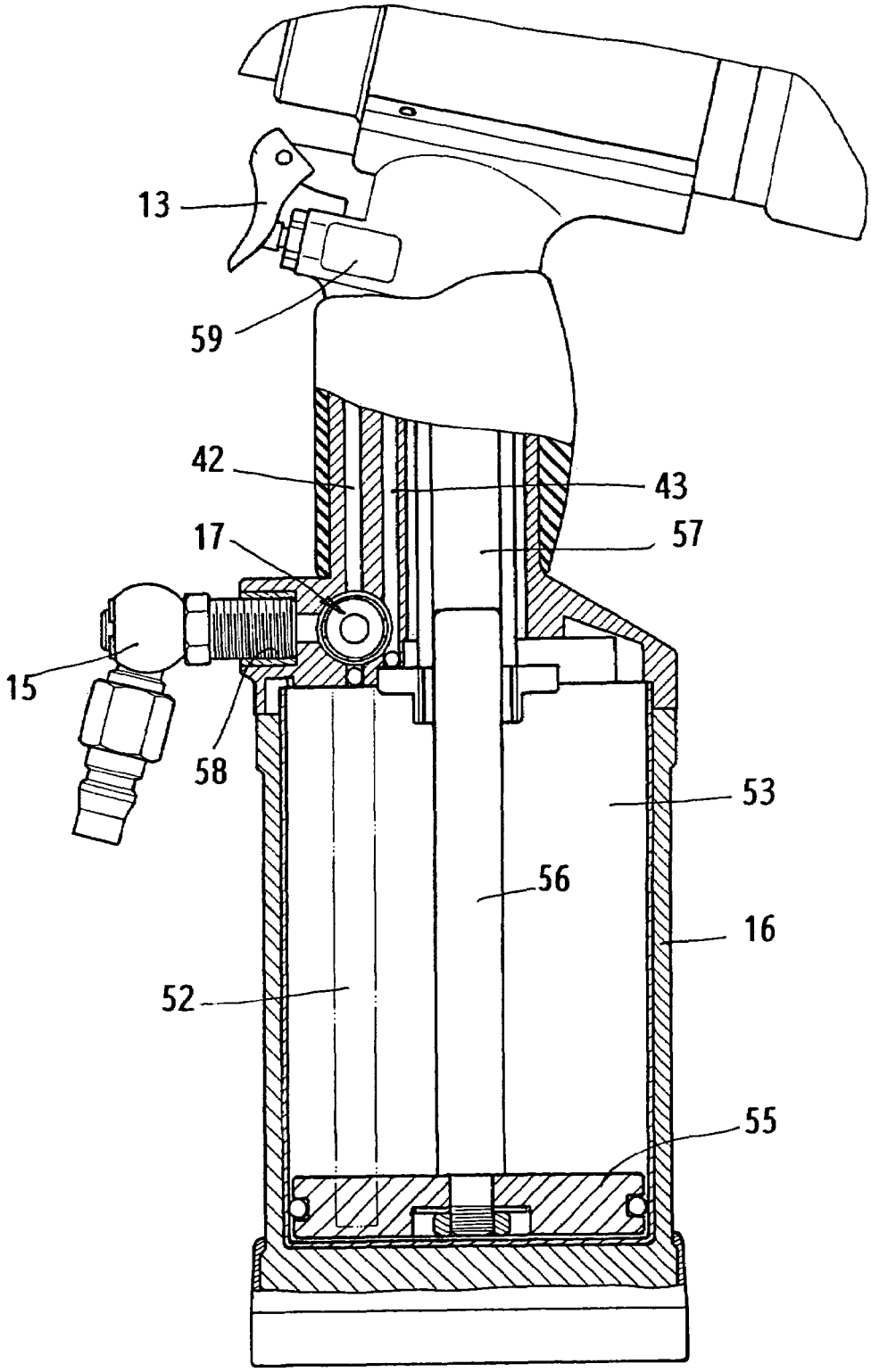
FIG. 2 is a sectional view of the present invention, showing a partial structure of the rivet-nut gun.

This invention relates to an intake control valve assembly of a rivet-nut gun; as shown in FIGS. 1 and 2, a pressure accumulator 16 is mounted under the handle 12 of the rivet-nut gun 11. The front of the handle 12 is furnished with a trigger 13, in which a control valve 59 is mounted for supplying and distributing a pressure air into the body 18; then, the pressure air can flow, through a passage hole 43 and a guide pipe 52, into a lower space 54 of the piston 55 so as to push the piston 55 to move upwards; simultaneously, the piston rod 56 will be pushed into the hydraulic chamber 57 to convert into a hydraulic power to enable the rivet-nut gun to work.

Figure 3:
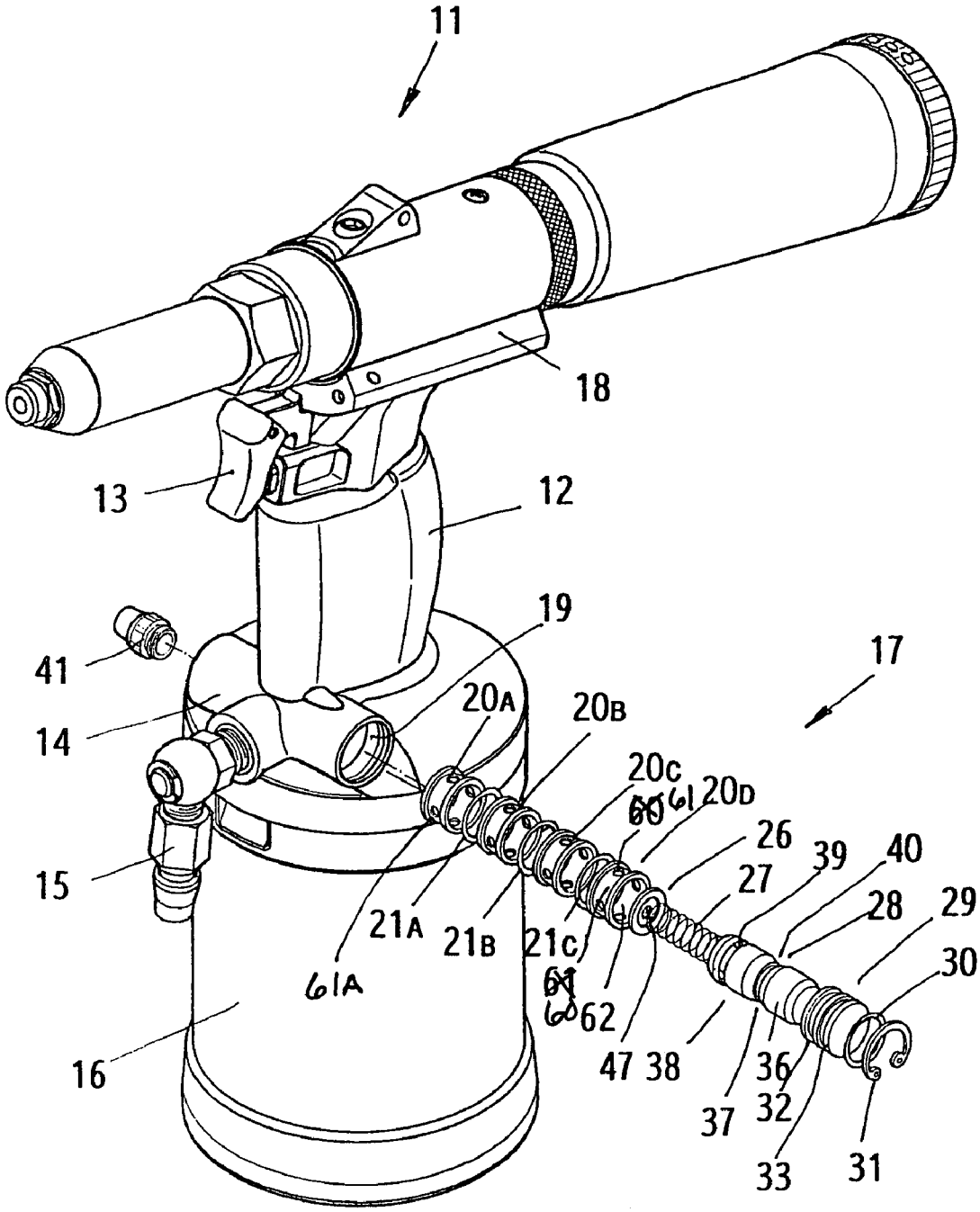
FIG. 3 is a disassembled view of the present invention, showing the pressure-switching assembly of the rivet-nut gun.
Figure 4:
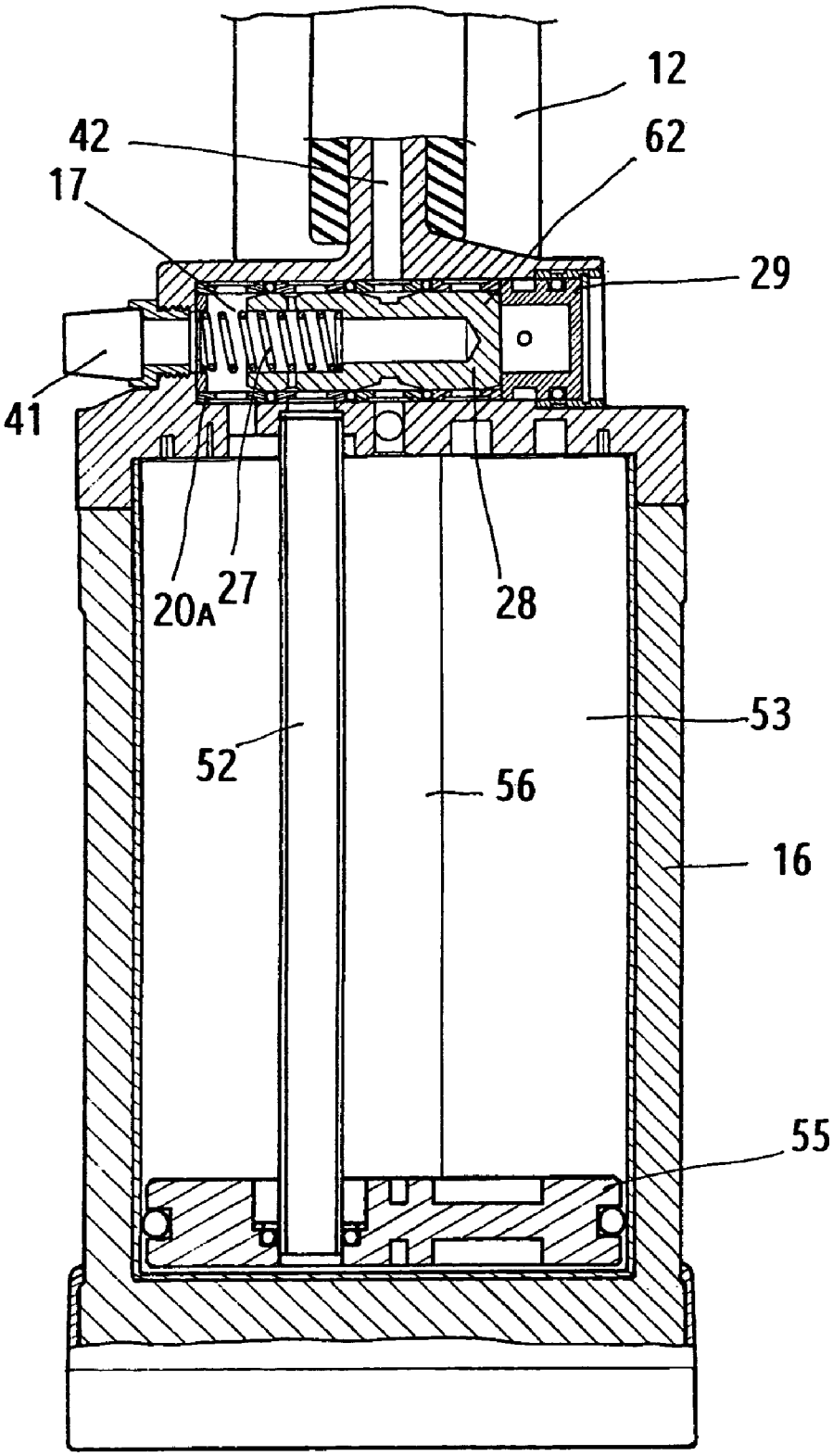
FIG. 4 is a sectional view of the present invention, showing the structural relation of the pressure accumulator thereof.

Referring to FIGS. 3 and 4, a pressure accumulator 16 is mounted under the handle 12 of the rivet-nut gun 11; the upper end of the pressure accumulator 16 is mounted with a valve cylinder 14, of which the mid-outer side has a threaded hole 58 mounted with a quick connector 15 to be connected with a pressure air pipe; the inner space of the valve cylinder 14 is substantially a hollow cylinder 19, of which the outer end is mounted with a bushing 44; the other end of the hollow cylinder 19 is furnished with a cylindrical hole and a threaded hole 48 to be mounted with a muffling screw 41; the inside of the hollow cylinder 19 is mounted with an intake valve assembly 17 which includes a plurality of spacing rings 20, and seal rings 21, a positioning disk 26, a spring 27, a valve rod 28, a fastening ring 29 and an O-ring 30; after the intake valve assembly 17 is mounted in place, it will be fastened in place with a retaining ring 31, i.e., the intake valve assembly 17 is fastened in the hollow cylinder 19.

Referring to FIGS. 2 to 5, the lower side of the hollow cylinder 19 in the valve cylinder 14 is furnished with a through hole 50 connected with a guide pipe 52, and the guide pipe 52 extends through the piston 55 and into a lower space 54; an upper cylindrical wall (not numbered) has a through hole 49 nearing a spacing ring 20*a*, and the through hole 49 is used as an exhaust hole of the upper space 53 of the piston 55; the hollow cylinder 19 has a cylindrical hole 62 within the spacing rings 20, and the cylindrical hole 62 is designed to fit to the outer surface 36 of the valve rod 28 in a close contact state. The outer surface of the spacing rings 20 is furnished with ring-shaped grooves 60 respectively, and both sides of each ring-shaped groove 60 are in close contact with the inner surface of the hollow cylinder 19; the ring-shaped groove 60 of each spacing ring 20 is furnished with a plurality of through holes 61 to be in communication with the cylindrical hole 62; a seal ring 21 is mounted between every two spacing rings 20; the seal ring 21 is substantially an O-ring to have two spacing rings 20 separated from each other.

The cylindrical hole 62 formed in the spacing rings 20 and the seal rings 21 inside the hollow cylinder 19 is loaded regularly with a positioning disk 26, a spring 27 and a valve rod 28; the center of the positioning disk 26 is furnished with a through hole 47 and a recess surface; the positioning disk 26 is pushed against the bottom of the hollow cylinder 19 by means of the spring 27; the through hole 47 of the positioning disk 26 is in communication with the muffling screw 41 so as to exhaust pressure air and to muffle noise. The valve rod 28 mounted in the spacing rings 20 and the seal rings 21 has a cylindrical hole 46 for receiving one end of the spring 27, and the spring 27 is used for providing a push force to the valve rod 28.

The outer surface 36 of the valve rod 28 is furnished with two sets of ring-shaped grooves 37 and 38; the ring-shaped groove 37 is furnished with a V-shaped ring groove 40, of which the bottom has a U-shaped ring groove 63; the other set of ring-shaped groove 38 is substantially a V-shaped ring groove, which includes a plurality of through holes 39 in communication with the center cylindrical hole 46. When the rivet-nut gun 11 is not in use, the valve rod 28 is furnished with a push force by means of the spring 27, and the ring-shaped groove 27 on the valve rod 28 is opposite the passage hole 42 in the handle 12 so as to facilitate a pressure air to flow through the ring-shaped groove 60 of the spacing ring 20C and into the valve of the trigger 13. The ring-shaped groove 38 is furnished beside the inner side of the spring ring 20B, and the V-shaped ring groove thereof is in communication with the through hole 61 of the spacing ring 20B; the ring-shaped groove 60 on the outer side of the through hole 61 is opposite the through hole 50 on the pressure accumulator 16; the guide pipe 52 is in communication with the lower space 54 under the piston 55 so as to provide the lower space 54 with an exhaust passage, and to facilitate the air in the lower space 54 to be exhausted via the guide pipe 52, the through hole 50, the ring-shaped groove 60 of the spacing ring 20B, the through hole 61, the ring-shaped groove 38 of the valve rod 28, the through hole 39, and the cylindrical hole 46 upon the piston 55 moving downwards.

Figure 5:
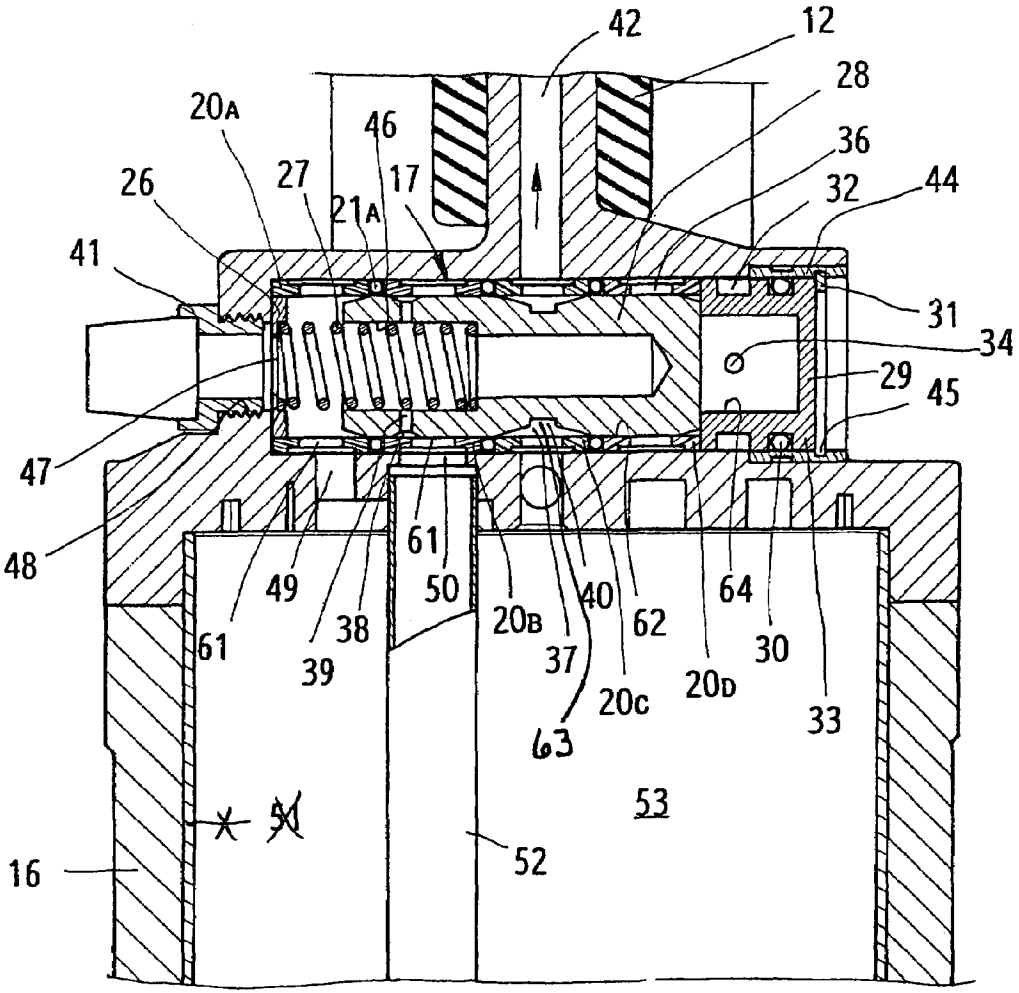
FIG. 5 is a sectional view of the pressure invention, showing a shifting state of the valve rod on the upper pressure accumulator thereof.
Figure 6:
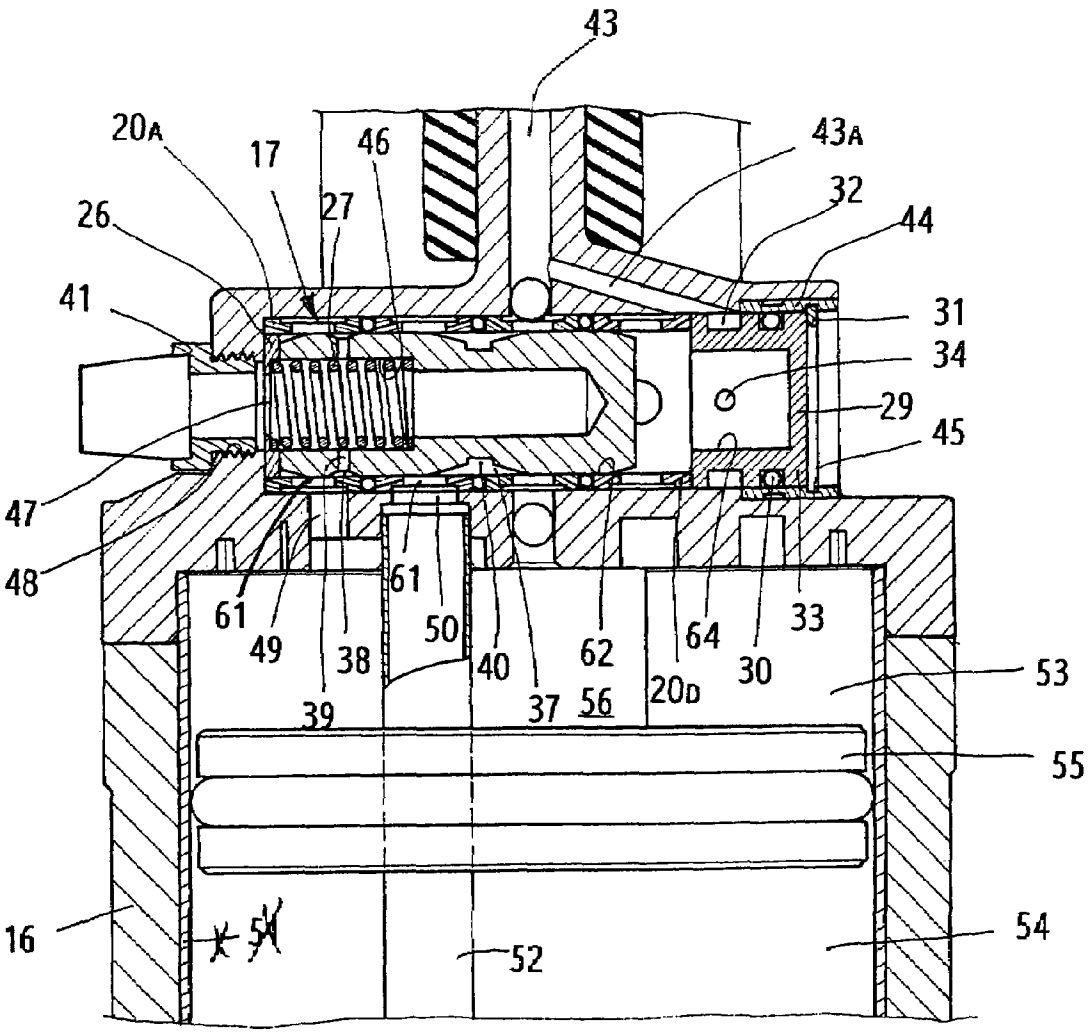
FIG. 6 is a sectional view of the present invention, showing another shifting state of the valve rod on the upper pressure accumulator thereof.

Referring to FIGS. 5 and 6, the hollow cylinder 19 is first loaded with a plurality of spacing rings 20 and seal rings 21, of which the center space is loaded with a positioning disk 26, a spring 27 and a valve rod 28; then, a fastening ring 29 is mounted on the end of the hollow cylinder 19 before a retaining ring 31 being mounted in place; the ring surface 33 of the fastening ring 29 is furnished with a ring-shaped groove 32, and an O-ring 30; the ring-shaped groove 32 is furnished with a plurality of through holes 34 in communication with the center cylindrical hole 64; the ring-shaped groove 32 on the surface of the fastening ring 29 is in communication with the passage hole 43 in the handle 12; the passage hole 43 is connected with the valve inside the trigger 13; when the trigger 13 is actuated, a pressure air will flow through the passage hole 43, the ring-shaped groove 32 of the fastening ring 29, a plurality of through holes 34 to enter the center cylindrical hole 64 so as to push the valve rod 28 to move inwards, and to change the passage structure in the valve cylinder 14.

As shown in FIGS. 1, 2 and 5, after the riveting operation of the rivet-nut gun 11 is ended or is being done, the piston 55 and the piston rod 56 in the pressure accumulator 16 will be pushed to the lowest position as a result of a push-back spring in the body 18 and the liquid in the hydraulic chamber 57; the outer end of the valve rod 28 in the hollow cylinder 19 of the valve cylinder 14 will be in contact with the end of the fastening ring 29 as a result of the pushing force of the spring 27, and the valve rod 28 is in a still condition; in that case, the ring-shaped groove 37 of the valve rod 28 is opposite the spacing ring 20C, of which the ring-shaped groove 60 is in communication with a connector and the passage hole 42 of the handle 12; since the connector 15 of the rivet-nut gun 11 is connected with the pressure-air guide pipe, the pressure air can flow via the spring ring 20C, and into the passage hole 42 of the handle 12 and to the front end of the control valve 59.

When the rivet-nut gun 11 is operated, the trigger 13 of the handle 12 is pressed downwards, and the control valve 59 in the trigger 13 is opened so as to have the pressure air flowed through another passage hole 43 to flow back into the valve cylinder 14. Referring to FIGS. 2 and 6, the pressure air flow through the passage hole 43 and a side passage hole 43*a* and into the ring-shaped groove 32 of the fastening ring 29, and then flows via the through hole 34 and into the either cylindrical hole 64 to push the valve rod 28 to move inwards; then, the ring-shaped grooves 37 and 38 on the outer surface 36 of the valve rod 28 will also move inwards; the contact condition between the groove and spacing rings 20 will change so as to have the pressure air flowed via the guide hole 52 and into the lower part of the piston 55 and to push the piston 55 to move upwards; upon the piston 55 moving upwards, the piston rod 56 in the hydraulic chamber 57 will move upwards to cause the hydraulic liquid in the hydraulic chamber 57 to generate a hydraulic force for riveting work.

Upon the trigger 13 of the rivet-nut gun 11 being pulled, the pressure air flows, via the passage hole 43, to one end of the valve rod 28 to push the valve rod to move; then, the ring-shaped groove 37 on the outer surface 36 of the valve rod 28 will be moved to a position nearing a through hole 61*a* of the spacing ring 20*a*; since the ring-shaped groove 38 and the through hole 61*a* are in communication, and the same is true between the through hole 61*a* and the through hole 49 of the pressure accumulator 16, the air in the upper space 53 of the piston 55 can be exhausted out of the muffling screw 41 via the passage hole, the through hole 39 of the ring-shaped groove 38 and the center cylindrical hole 46 of the valve rod 28. The V-shaped ring groove 40 on the outer surface 36 of the valve rod 28 has a wider surface, and it can move nearing the through hole 61*b* of the spacing ring 20*b* on the guide pipe 52 upon the valve rod 28 moving; in other words, the communication between the V-shaped ring groove 40 and the passage hole 42 would not be affected, and the pressure air supply would not be affected as well; further, the pressure air can flow via the through hole 61 of the spacing ring 20*b*, the through hole 50 on the pressure accumulator 61, and the guide pipe 52, and into the lower space 54 of the piston 55 so as to push the piston 55 move upwards; then, the air in the upper space 53 of the piston 55 will flow out of the muffling screw 41 via the through hole 49 of the pressure accumulator 16, the through hole 61*a* of the spacing ring 20*a*, the ring-shaped groove 38 of the valve rod 28, the through hole 39, the center cylindrical hole 46 and the center through hole of the positioning disk 26.

According to the present invention, a valve cylinder 14 is furnished under the handle 12 of the rivet-nut gun 11, and the valve cylinder 14 is loaded with a plurality of spacing rings 20, a plurality of seal rings 21, a valve rod 28 and related parts in the center space of the aforesaid rings; the valve rod 28 can have the pressure air distributed and guided; as soon as the trigger 13 is pulled, the pressure air will be distributed and flow into the lower space 54 of the piston 55 in the pressure accumulator 16 so as to cause the piston 55 and the piston rod 56 to move; then, the hydraulic chamber 57 will generate a power for riveting work.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. An intake control valve assembly of a rivet-nut gun comprising: a valve cylinder mounted between a handle and a pressure accumulator, and said valve cylinder mounted with an intake control valve which includes:

a connector mounted on said valve cylinder on said pressure accumulator, a hollow cylinder is located in a center of said valve cylinder; said hollow cylinder mounted with a control valve facing a trigger of the handle, and said control valve furnished with an intake passage and a guide passage; one side of said hollow cylinder furnished with a threaded hole mounted with a muffling screw inserted therein;

a plurality of spacing rings, of which each outer surface is furnished with a ring-shaped groove; a surface on both sides of said ring-shaped groove being in contact with an inner surface of said hollow cylinder; a center of said spacing rings is furnished with a cylindrical hole; a surface of each said ring-shaped groove is furnished with a plurality of through holes; a seal ring mounted between every two of said spacing rings;

a seal ring being substantially an O-ring to be mounted between two said spacing rings;

a positioning disk being a round disk with a center through hole, and mounted on a bottom of said hollow cylinder;

a spring, of which a first end being mounted on said positioning disk, and a second end extending into a center cylindrical hole of said valve rod and pushing against an inner surface thereof;

a valve rod having a center cylindrical hole, and an outer surface thereof furnished with two sets of ring-shaped grooves for receiving a plurality of spacing rings and seal rings arranged alternately;

a fastening ring having a center cylindrical hole, and an outer surface thereof furnished with ring-shaped grooves having a through hole in communication with said center cylindrical hole, and said fastening ring mounted on an outer end of said hollow cylinder and being fastened in place with a retaining ring.

2. An intake control valve assembly of a rivet-nut gun as claimed in claim 1, wherein an outer surface of said valve rod is furnished with ring shaped grooves including a V-shaped ring groove and a U-shaped ring groove; said V-shaped ring groove having a wide surface, and having a U-shaped ring groove located on a bottom thereof.

3. An intake control valve assembly of a rivet-nut gun as claimed in claim 1, wherein an outer surface to said valve rod is furnished with a ring-shaped groove, which having has a plurality of through holes in communication with said center cylindrical hole.

4. An intake control intake assembly of a rivet-nut gun as claimed in claim 1, wherein said fastening ring is furnished with a ring-shaped groove in communication with a guide passage in said handle.

* * * * *